US005722654A

United States Patent [19]

Sootome et al.

[11] Patent Number: 5,722,654

[45] Date of Patent: Mar. 3, 1998

[54] SHEET SUPPLYING APPARATUS

[75] Inventors: Sumitoshi Sootome, Yachiyo; Kazuyuki Morinaga, Yokohama; Hisayuki Tomura, Machida, all of Japan

[73] Assignee: Canon Kabushiki Kaisha, Tokyo, Japan

[21] Appl. No.: 732,719

[22] Filed: Oct. 18, 1996

Related U.S. Application Data

[62] Division of Ser. No. 372,830, Jan. 13, 1995, Pat. No. 5,571,265, which is a continuation of Ser. No. 77,866, Jun. 18, 1993, abandoned.

[30] Foreign Application Priority Data

Jun. 19, 1992 [JP] Japan ..... 4-186353
Jun. 29, 1992 [JP] Japan ..... 4-171085

[51] Int. Cl.[6] ..... B65H 3/06

[52] U.S. Cl. ..... 271/119; 271/116; 271/122; 271/127; 271/164

[58] Field of Search ..... 271/119, 122, 271/126, 127, 164, 170, 116

[56] References Cited

U.S. PATENT DOCUMENTS

| | | | |
|---|---|---|---|
| 3,937,455 | 2/1976 | Hauser . | |
| 3,961,786 | 6/1976 | Yanker | 271/122 |
| 4,438,915 | 3/1984 | Akamatsu et al. . | |
| 4,635,919 | 1/1987 | Habich et al. . | |
| 4,966,356 | 10/1990 | Ohyabu et al. | 271/164 |
| 5,002,266 | 3/1991 | Kikuchi et al. . | |
| 5,029,838 | 7/1991 | Kunihiro . | |
| 5,115,281 | 5/1992 | Ohtsuka et al. . | |
| 5,192,067 | 3/1993 | Saito . | |
| 5,201,873 | 4/1993 | Kikuchi et al. . | |
| 5,351,945 | 10/1994 | Asakawa et al. | 271/127 |
| 5,401,014 | 3/1995 | Okabe et al. | 271/164 |
| 5,443,252 | 8/1995 | Morinaga | 271/164 |
| 5,571,265 | 11/1996 | Yagi et al. | 271/116 |

FOREIGN PATENT DOCUMENTS

| | | | |
|---|---|---|---|
| 0386737 | 9/1990 | European Pat. Off. . | |
| 55-165837 | 12/1980 | Japan . | |
| 0107339 | 7/1982 | Japan | 271/127 |
| 0167137 | 7/1987 | Japan | 271/127 |
| 63-82252 | 4/1988 | Japan . | |
| 1-92148 | 4/1989 | Japan . | |
| 0172128 | 7/1989 | Japan | 271/164 |
| 1-236129 | 9/1989 | Japan . | |
| 2-152830 | 6/1990 | Japan . | |
| 4-140239 | 5/1992 | Japan . | |
| 4-246032 | 9/1992 | Japan . | |
| 2206104 | 12/1988 | United Kingdom | 271/127 |

*Primary Examiner*—H. Grant Skaggs
*Attorney, Agent, or Firm*—Fitzpatrick, Cella, Harper & Scinto

[57] ABSTRACT

The present invention provides a sheet supplying apparatus having a sheet stacking device for stacking and supporting sheets, a sheet supply roller having different radial dimensions along a periphery thereof to feed out the sheets from the sheet stacking device, and a separation unit having a feed rotary member rotated in a sheet feeding direction and a reverse rotary member rotated in a direction opposite to the sheet feeding direction to separate the sheets fed out by the sheet supply roller one by one.

16 Claims, 15 Drawing Sheets

SHEET SUPPLYING APPARATUS

This application is a division of application Ser. No. 08/372,830, filed Jan. 13, 1995, now U.S. Pat. No. 5,571, 265, which is a continuation of application Ser. No. 08/077, 866, filed Jun. 18, 1993, now abandoned.

BACKGROUND OF THE INVENTION

1. Field of the Invention

The present invention relates to a sheet supplying apparatus for a copying machine, a printer and the like, and more particularly, it relates to a sheet supplying apparatus of retard roller type which is cheap and simple and which has good sheet supplying and separating ability.

2. Related Background Art

In conventional sheet supplying apparatus of a so-called retard roller type wherein sheets stacked in a sheet supply cassette are separated and supplied one by one by three kinds of rollers comprising a sheet supply roller, a normal rotation roller and a reversible retard roller to feed the separated sheet to an image forming station, it is necessary to provide a lifter mechanism for maintaining a height of a top surface of the sheet stack substantially constant. The lifter mechanism is an effective means not only in the sheet supplying apparatus of retard roller type but also in sheet supplying apparatuses of other types, since a contact pressure between the sheet supply roller and the sheet stack can be easily kept constant regardless of a thickness of the sheet stack by utilizing a weight of the roller itself and the like.

Now, the conventional sheet supplying apparatus will be explained with reference to FIG. 18.

In FIG. 18, the reference numeral 1 denotes an image forming apparatus such as a copying machine, a printer and the like; 2 denotes a sheet supply cassette; 3 denotes an intermediate plate pivotable around shafts 2*a* fixed to the sheet supply cassette 2; and S denotes a stack of transfer sheets. The reference numeral 4 denotes a height detection sensor for measuring a height of a top surface of the sheet stack, wherein movement of a lever made of resin such as polycarbonate is detected by a photo-interrupter, for example.

A lifter plate 5 serves to lift the intermediate plate 3 and is fixed to a lifter shaft 6 rotated by a lifter drive motor 6*a*. A sheet supply roller 7 can be rotated in a direction shown by the arrow and can be shifted in an up-and-down direction. The reference numeral 8 denotes a normal rotation drive roller; 9 denotes a retard roller which includes a torque limiter in its driving system; and 10 and 11 denote a pair of feed rollers.

Next, an operation of the sheet supplying apparatus will be briefly explained.

When a sheet supply signal is emitted, the sheet supply roller 7 is lowered to abut against the sheet stack and is rotated to supply an uppermost sheet of the sheet stack. Then, the supplied sheet enters between the normal rotation drive roller 8 and the retard roller 9. In this case, if a single sheet enters between the normal rotation drive roller and the retard roller, the retard roller 9 is rotated in a sheet feeding indirection; whereas, if two or more sheets enter between the normal rotation drive roller and the retard roller, the retard roller 9 is rotated reversely by the action of the torque limiter to successively return the sheet from the lowermost one toward the sheet supply cassette, thereby preventing the double-feed of the sheets. Further, the sheet supply roller 7 is shifted upwardly when a predetermined time is elapsed after the leading ends of the sheets have entered between the normal rotation drive roller 8 and the retard roller 9, so that the returned sheets can be smoothly returned back toward the sheet supply cassette.

In this way, by supplying the sheets successively from the uppermost one, a height of the top surface of the sheet stack is gradually decreased. When the fact that the height of the top surface of the sheet stack is decreased below a predetermined height is detected by the height detection sensor 4, the lifter drive motor 6*a* is rotated by a certain short time to lift the intermediate plate 3, thereby lifting the top surface of the sheet stack up to the predetermined level.

By repeating the above operations, the sheets can be successively supplied one by one.

However, in the above-mentioned conventional sheet supplying apparatus of retard roller type, as mentioned above, since the lifter mechanism 5, 6, 6*a* for the intermediate plate 3, the height detection sensor 4 and the mechanism for lowering and lifting the sheet supply roller 7 are required, the apparatus becomes considerably expensive and complicated in comparison with sheet supplying apparatuses of separation claw type and of dupro type, and has an disadvantage in a spatial problem, whereby it could not be adopted to a compact copying machine, a compact printer and the like.

SUMMARY OF THE INVENTION

An object of the present invention is to eliminate the above-mentioned conventional drawbacks, i.e., the complication, expensiveness and the increase in the installation space.

To achieve the above object, a sheet supplying apparatus according to the present invention comprises sheet stacking means such as a sheet supply cassette, sheet supply means for effecting one revolution control of a semi-circular sheet supply roller which is mounted on a shaft and does not move in an up-and-down direction, separation and feed means comprising a pair of retard rollers disposed at a downstream side of the sheet supply means and adapted to prevent the double-feed, and convey means comprising a pair of convey rollers disposed at a downstream side of the separation and feed means.

Further, among the paired retard rollers, a rotation drive control of a normal rotation drive roller is effected in synchronous with one revolution of the semi-circular sheet supply roller.

With this arrangement, it is possible to greatly reduce the complication and cost in comparison with the conventional sheet supplying apparatus of retard roller type and to provide a sheet supplying apparatus which is effective regarding the installation space.

DETAILED DESCRIPTION OF THE PREFERRED EMBODIMENTS

Figure 1:
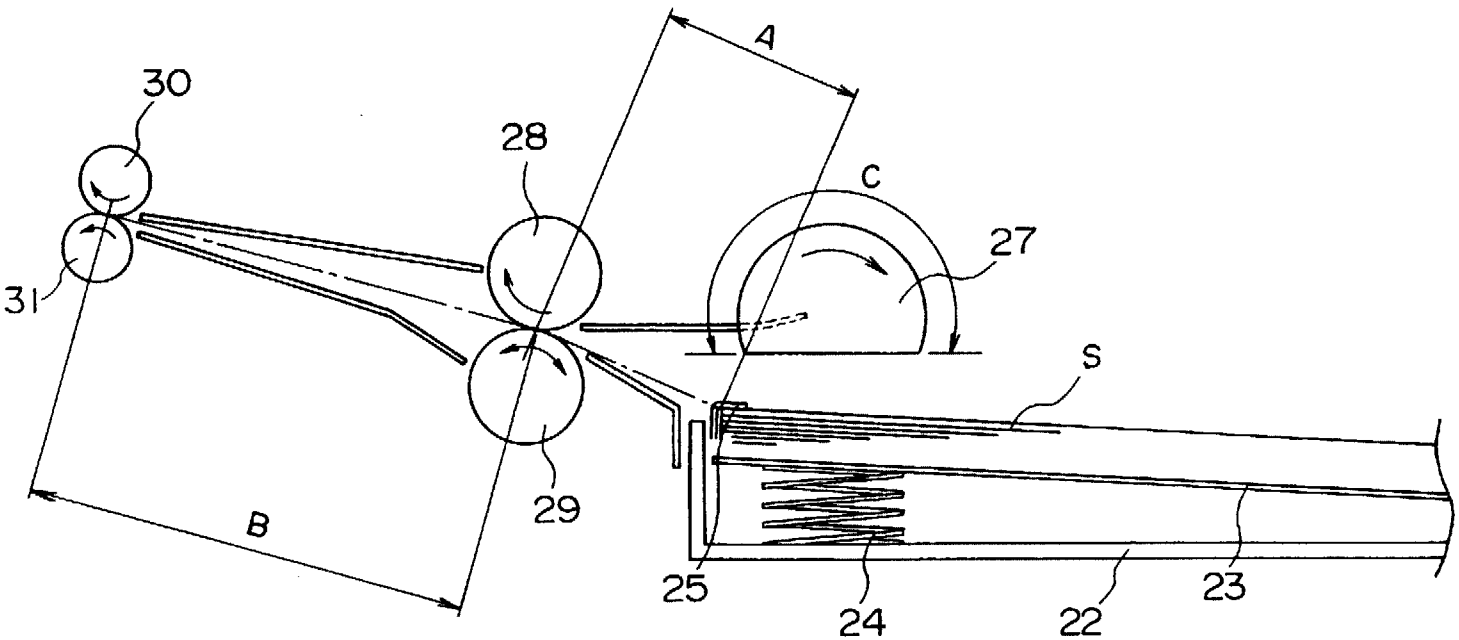
FIG. 1 is an elevational sectional view of a sheet supplying apparatus according to a first embodiment of the present invention.
Figure 2:
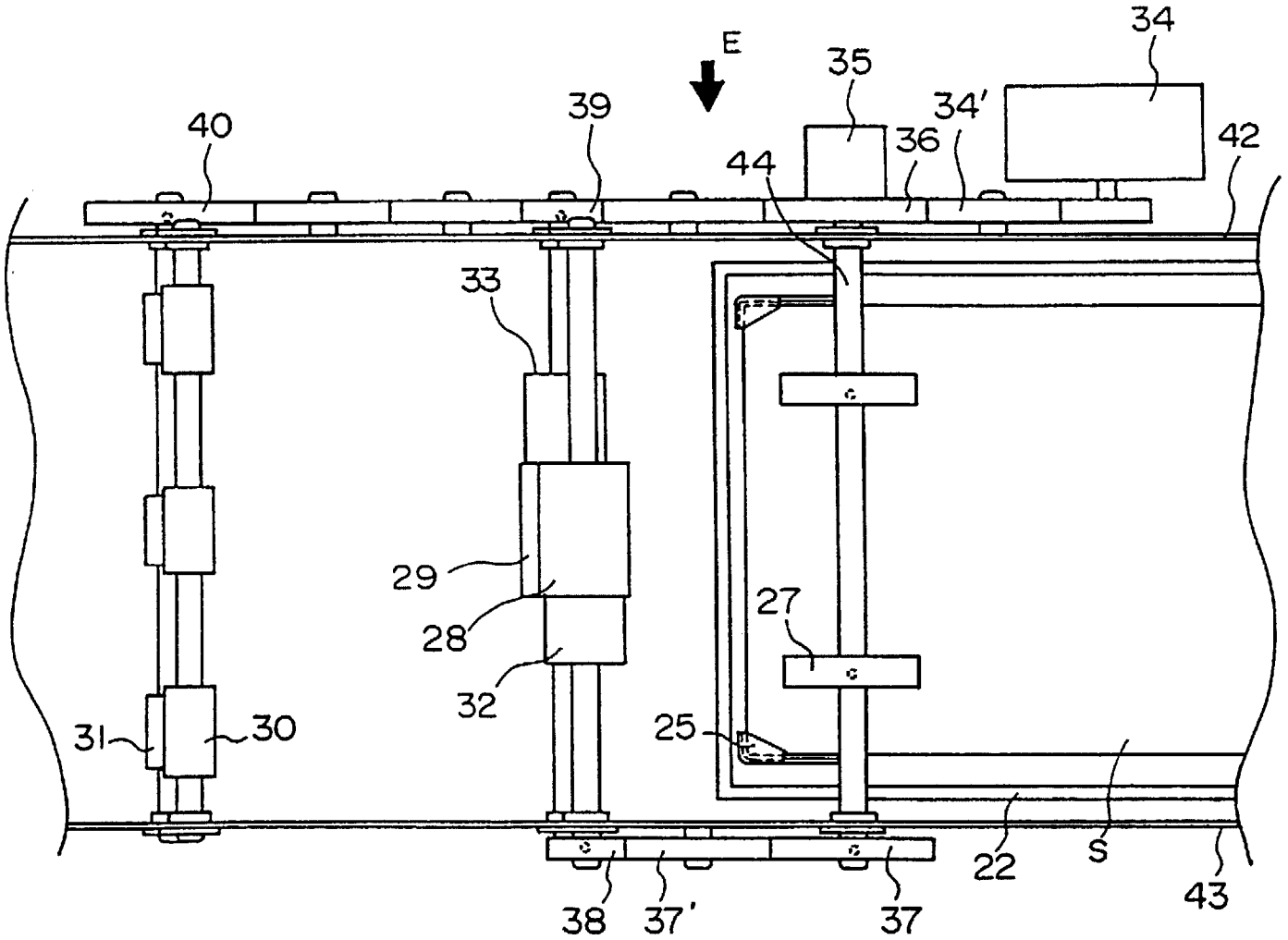
FIG. 2 is a plan view of the apparatus of FIG. 1.
Figure 3:
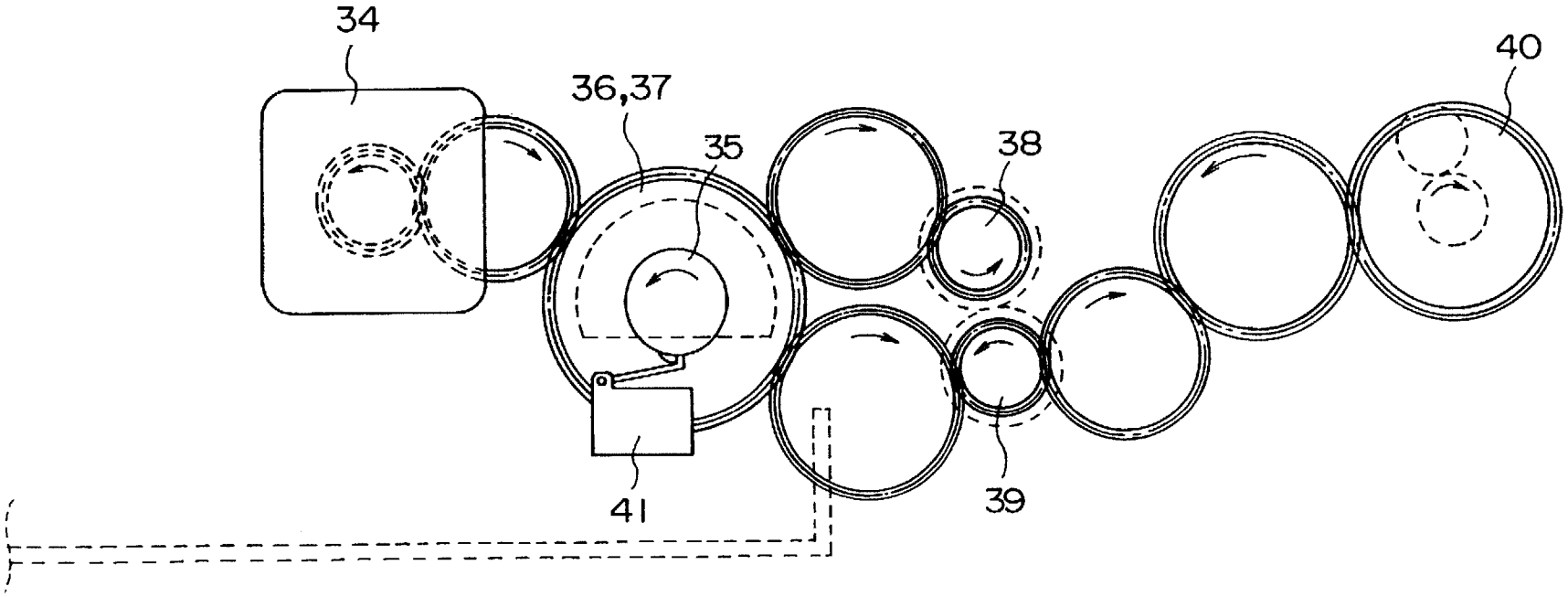
FIG. 3 is a side view of a gear train shown in FIG. 2.

FIGS. 1 to 4 shows a first embodiment of the present invention, where FIG. 1 is an elevational sectional view of a sheet supplying apparatus, FIG. 2 is a top plan view of the apparatus, and FIG. 3 is a gear train looked at from a direction shown by the arrow E in FIG. 2.

In FIGS. 1 to 4, a sheet supply cassette 22 made of ABS resin or the like has an intermediate plate 23 acting as a sheet stacking plate pivotable around a pivot (not shown) disposed at a rear portion of the cassette, which plate is biased upwardly by a compression spring 24. Auxiliary separating pawls or claws 25 serve to catch left and right front corners of the sheets, similar to conventional separating claws of claw separating type. However, in this case, the catching amount (for the sheets) of the separating claws may be smaller than that of the conventional separating claws, since these separating claws 24 has a main purpose for regulating the top surface of the sheet stack and a pair of retard rollers as a main separation means are disposed at a downstream side of the separating claws, and since the handling of thick sheets can be facilitated.

A sheet supply roller 27 has a semi-circular shape as shown. A normal rotation drive roller 28 has a one-way clutch 32, and a retard roller 29 is subjected to a driving force through a torque limiter. A pair of feed rollers 30, 31 serve to feed the sheet from the paired retard rollers 28, 29 to an image forming station.

Explaining a driving transmitting system, by rotating a motor 34, a sheet supply clutch gear 36, a retard roller gear 39 and a feed roller gear 40 are rotated via an idler gear 34'. Further, a one revolution transmitting gear 37 is secured to a sheet supply roller shaft 44 by a spring pin or the like at the other end of the shaft opposite to the sheet supply clutch gear 36, which one revolution transmitting gear is connected to a normal rotation drive roller gear 38 via an idler gear 37'. Although the sheet supply clutch gear 36 is normally rotated idly with respect to the shaft 44, when a solenoid 41 is turned ON (attracted) as a sheet supply start signal is emitted from an image forming apparatus, the sheet supply roller 27 is rotated by one revolution together with the shaft 44 by the action of a conventional spring clutch 35.

Now, the sheet supply, sheet separation and sheet feeding will be fully explained.

As mentioned above, when the solenoid 41 is turned ON to rotate the sheet supply roller 27 by one revolution by the sheet supply start signal, a leading end of an uppermost sheet of the sheet stack is disengaged from the auxiliary separating claws 25 and enters between the paired retard rollers 28, 29.

As mentioned above, the retard roller 29 has the driving force transmitting mechanism that can be rotated idly when a torque more than a predetermined value is applied thereto; that is, the retard roller is connected to a driving source via the so-called torque limiter 33. Thus, when a single sheet is sent, the load torque applied to the torque limiter 33 from the sheet via the retard roller 29 exceeds the predetermined value, with the result that the torque limiter 33 is rotated idly, whereby the retard roller 29 is driven by the movement of the sheet fed by the normal rotation drive roller 28. On the other hand, if two or more sheet are sent (because a single sheet could not be separated by the auxiliary separating claws 25), the friction force between the sheets is applied to the torque limiter 33 as the load torque via the retard roller 29. Since the friction force is smaller than the predetermined value, the torque limiter 33 does not effect the idle rotation, thereby rotating the retard roller in a direction that the sheet is returned toward the sheet supply cassette.

That is to say, when the single sheet is sent to the paired retard rollers 28, 29, the sheet is fed to the image forming station through the paired feed rollers 30, 31; whereas, if two or more sheets are sent to the paired retard rollers, the lower sheets are successively separated and returned toward the sheet supply cassette, with the result that only a single sheet is fed to the image forming station through the paired feed rollers 30, 31.

On the other hand, as mentioned above, the normal rotation drive roller 28 is driven in synchronous with one revolution of the sheet supply roller 27 so that the sheet is fed to the paired feed rollers 30, 31 until the sheet supply roller 27 is rotated by one revolution. The normal rotation drive roller 28 is driven via a conventional one-way clutch so that, after the sheet supply roller 27 was rotated by one revolution, the normal rotation drive roller is driven or rotated by the movement of the sheet fed by the paired feed rollers 30, 31.

In this way, in comparison with the conventional sheet supplying apparatus of retard roller type, since a lifting/lowering mechanism for the sheet supply roller 27 and a height detection device for detecting the top surface of the sheet stack are not required, and a special lifter is not also required, it is possible to greatly simplify the construction. However, in the present invention, the following condition regarding the arrangement of the paired rollers must be satisfied. This condition will be explained with reference to FIG. 1.

When a distance between a tip end of the sheet supply cassette 27 and a nip of the paired retard rollers 28, 29 is A, a distance between the nip of the paired retard rollers 28, 29 and a nip of the paired feed rollers 30, 31 is B and a distance that the sheet is moved by one revolution of the sheet supply roller 27 (a length of a contact area between the sheet and the sheet supply roller 27) is C, a relation $A<C<B$ must be satisfied.

(1) $A<C$ is apparent, because, if this relation is not satisfied, the sheet cannot reach the nip of the paired retard rollers 28, 29.

(2) The relation C<B will be explained with reference to FIG. 4.

Figure 4:
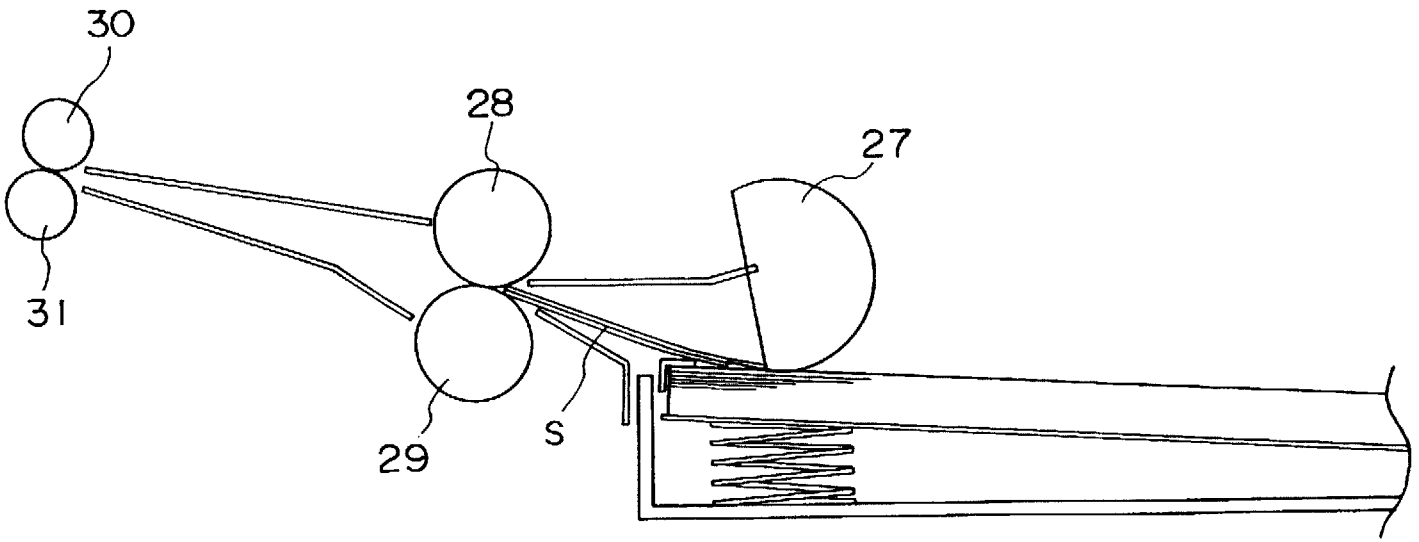
FIG. 4 is a view showing a condition that two sheets are simultaneously supplied in the apparatus of FIG. 1.

For example, as shown in FIG. 4, when it is assumed that two sheets are fed to the nip of the paired retard rollers 28, 29 in an overlapped condition, although the retard roller 29 is reversely rotated toward the sheet supply cassette to separate the overlapped sheets, since the sheet supply roller 27 is still abutted against the upper sheet, the lower sheet could not be returned toward the sheet supply cassette, with the result that it is feared that the lower sheet is also sent to the paired feed rollers 30, 31 together with the upper sheet. In this case, when the relation C<B is not satisfied, in the worst case, two sheets will enter into the nip of the paired feed rollers 30, 31, thus making the separation of the sheets impossible.

Figure 5:
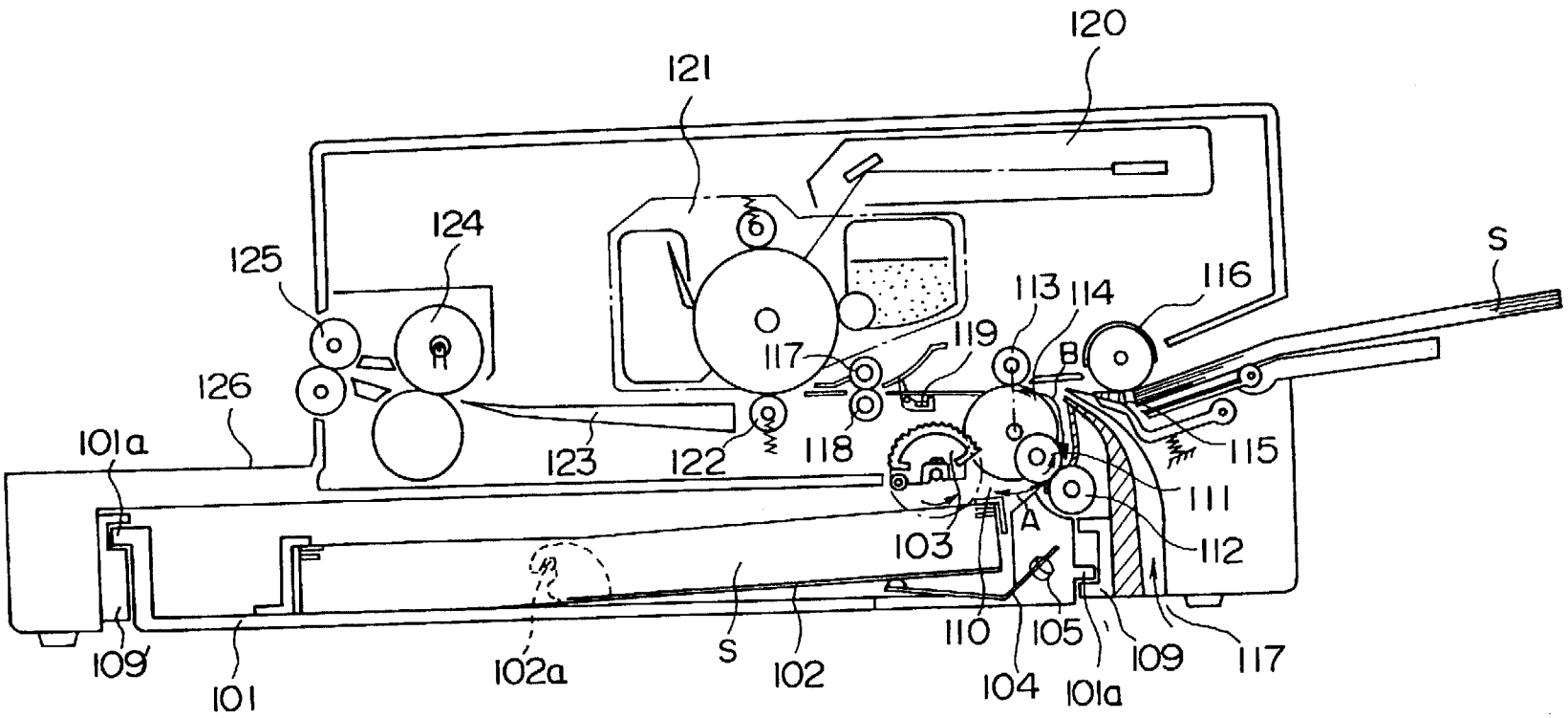
FIG. 5 is an elevational sectional view of a sheet supplying apparatus according to a second embodiment of the present invention.
Figure 6:
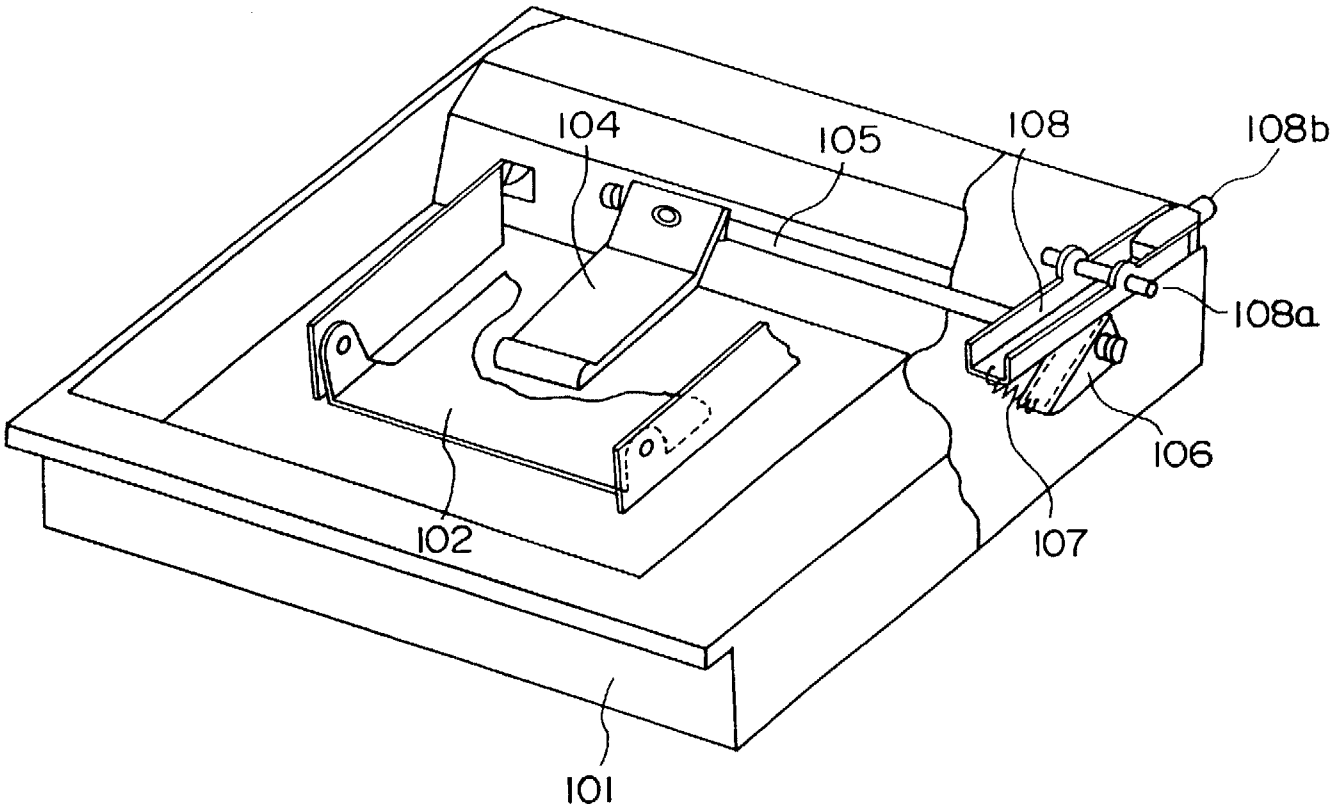
FIG. 6 is a perspective view of a cassette shown in FIG. 5.
Figure 7:
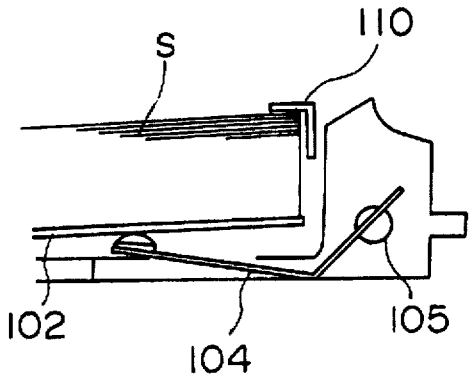
FIG. 7 is a partial sectional view showing a pressure plate of FIG. 5.
Figure 8:
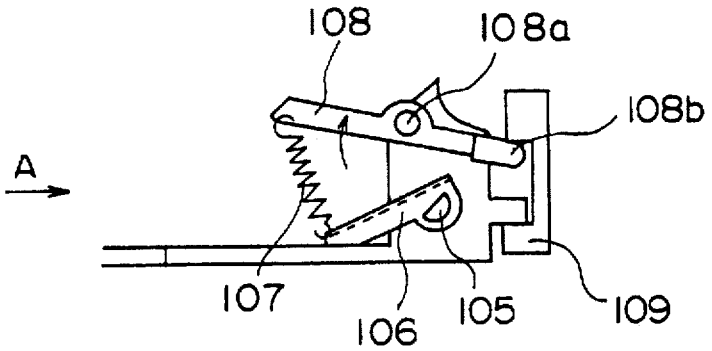
FIGS. 8 and 9 are sectional views showing a pressurizing mechanism for the pressure plate of FIG. 7.

FIG. 5 shows a second embodiment of the present invention, i.e., an electrophotographic printer to which the present invention is applied. A sheet supply cassette 101 which can be mounted and dismounted with respect to the printer from a front side (this side) thereof (in a direction perpendicular to the plane of FIG. 5) has a sheet stacking plate 102 pivotable around pivots 102*a*, and a pressure plate 104 disposed below the sheet stacking plate 102 at a center thereof and adapted to lift the sheet stacking plate together with the sheet stack thereon, thereby creating the sheet supplying pressure between the sheet stack and a semi-circular sheet supply roller 103. The pressure plate 104 is secured to a rotary shaft 105, a rotational force is transmitted to an end of the rotary shaft at this side thereof in the cassette inserting direction, and a pressure arm 106 is secured to this end of the rotary shaft 105. A pressure spring (tension spring) 107 having a spring force (pressurizing force) corresponding to the sheet supplying pressure has one end connected to the pressure arm 106 and the other end connected to a pressure control arm 108 for controlling the pressurizing force. The pressure control arm 108 is pivotally mounted around a support shaft 108*a*, and a member 108*b* made of POM (polyacetal) and the like having the good slidability is arranged on an end of the control arm opposite to the end to which the pressure spring 107 is connected.

Regarding the cassette inserting direction, rail members 109, 109' as supporting means for the cassette 101 are disposed at both widthwise sides, so that, when the sheet supply cassette is inserted into the image forming apparatus from this side, the rail portions are engaged by rail portions 101*a* of the sheet supply cassette 101, thereby permitting the smooth insertion of the cassette.

A cam portion 109*a* for engaging by the pressure control arm 108 is provided on the rail portion 109 formed on the apparatus so that the pressure control arm 108 is rotated by the cam portion 109*a* immediately before the inserting operation of the sheet supply cassette is completed. As a result, the pressure spring 107 is lifted or pulled to apply the spring force to the pressure arm 106, thereby transmitting the spring force to the pressure plate 104 via the rotary shaft 105. In this way, the sheet stack S on the sheet stacking plate 102 is lifted upwardly with a predetermined pressure. An upper position of the lifted sheet stack S is regulated by separating claws 110 arranged at front corners of the cassette.

Figure 10:
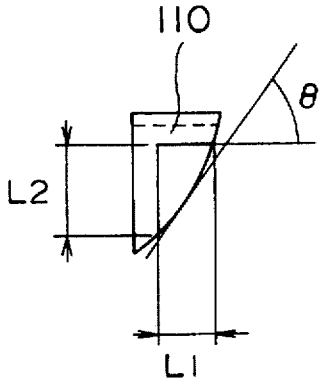
FIG. 10 is an explanatory view showing various dimension of a separating claw portion of FIG. 5.

Although the separating claws 110 as the upper limiting members may have a function for separating the sheets one by one when the sheets are supplied from the sheet supply cassette as in the conventional ones, since there are arranged a pair of retard rollers 111, 112 as a main separation means disposed at a downstream side of the sheet supply cassette, the separating claws having a main purpose for regulating the upper position of the sheet stack may be constituted as shown in FIG. 10. That is, a sheet catching amount and catching angle θ of the separating claw may be selected to more facilitate the riding of the sheet over the separating claw (i.e., to decrease dimensions L1, L2 and to increase the angle θ) in comparison with a conventional separating claw, thereby permitting the supply of thick sheets having 105 $g/m^2$ or 128 $g/m^2$ which cannot be supplied by the conventional separating claws. In this case, although it is feared that thin sheets having 60 $g/m^2$ may be double-fed, since several sheets are normally double-fed, these double-fed sheets can be sufficiently separated by the pair of retard rollers 111, 112.

The sheet stacking plate 102 is not subjected to the pressurizing force out of the apparatus so that the sheets can easily be loaded in the sheet supply cassette, and further, the sheet stacking plate is not subjected to the pressurizing force during the insertion of the sheet supply cassette into the apparatus so that the sheet supply cassette can be mounted and dismounted smoothly and the upper sheets cannot be caught by a frame of the apparatus. Since the pressurizing force acts on the sheet stacking plate immediately before the insertion of the cassette is completed, the sheets are well positioned.

Figure 9:
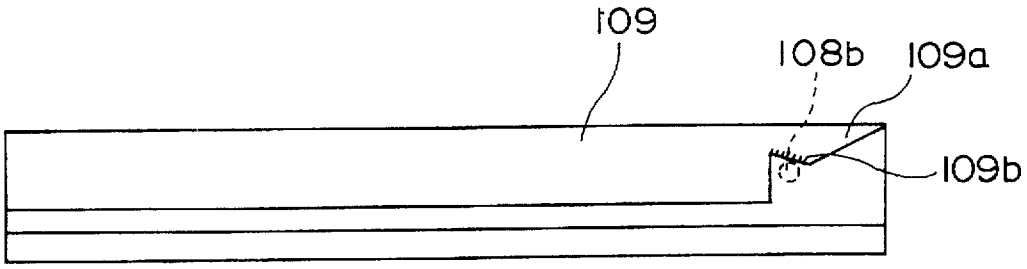

Further, as shown in FIG. 9, an inclined surface 109*b* is formed so that a force for pulling the sheet supply cassette toward that side of the apparatus by the pressure control arm 108 and the cam portion 109*a*. This inclined surface can also act as a locking means for the sheet supply cassette and push the sheet supply cassette 101 against a reference at that side.

As mentioned above, after the sheet supply cassette 101 containing the cut sheets S therein is mounted to the image forming apparatus, the sheet supply solenoid is turned ON by the sheet supply start signal, with the result that a control ring of the one revolution control spring clutch is released, thereby transmitting the driving force from the motor to the sheet supply roller 103. In this case, the driving force is also transmitted to the normal rotation drive roller 111 of the paired retard rollers 111, 112 at the downstream side of the spring clutch. Thus, by one revolution of the sheet supply roller 103, the normal rotation drive roller 111 is also rotated simultaneously. By setting the rotational speed of the sheet supply roller 103 to be the same as or slightly smaller than the rotational speed of the normal rotation drive roller 111, it is possible to prevent the slack of the sheet between the paired retard rollers 111, 112 and the sheet supply roller, thereby preventing the damage of the sheet. The rotational force is always applied to the other retard roller 112 via the torque limiter so that the double-fed sheets can be separated.

A U-turn sheet path is disposed at a downstream side of the paired retard rollers 111, 112, and a drive roller 113 and a driven idler roller 114 are arranged in the U-turn sheet path.

The idler roller 114 is disposed at an inner side of a U-turn portion and has a radius same as or slightly smaller than the radius of curvature of the U-turn portion. The roller 114 cooperates with the drive roller 113 to feed the sheet S fed from the paired retard rollers 111, 112. The normal rotation drive roller 111 is also one-revolution controlled together with the sheet supply roller 103 so that, after it feeds the leading end of the sheet up to the drive roller 113, the transmission of the driving force to the normal rotation drive roller is interrupted, thereby pulling the sheet S by the drive roller 113. In this case, since there is the idler roller 114, the sheet is pulled along the U-turn portion smoothly, and, even if the sheet is subjected to the back tension from the paired retard rollers 111, 112, the load on the drive roller 113 is reduced, thereby increasing the durability of the drive roller 113 and reducing the required torque.

Since a sheet S supplied from another sheet supply opening is also fed to a nip between the drive roller 113 and the idler roller 114, it is possible to reduce the number of feed roller pairs. In the illustrated embodiment, as well as the sheet supplied from the sheet supply cassette 103, a sheet supplied from a manual sheet supply portion through a separation pad 115 and a feed roller 116 and a sheet supplied from an optional sheet supply cassette (not shown) removably mounted to a lower portion of the image forming apparatus through a sheet feed path 117 are sent to the same feeding station (comprising the drive roller 113 and the idler roller 114), and such sheets are further fed by the same arrangement at the downstream side of the feeding station.

A pair of regist rollers 117, 118 are disposed at a downstream side of the drive roller 113, and a sheet leading end detection sensor 119 disposed in front of the paired regist rollers 117, 118 serves to detect a leading end of the sheet, after which the regist rollers are stopped temporarily at a predetermined timing. In this way, it is possible to form a loop of about 3 to 10 mm in the sheet between the paired regist rollers 117, 118 and the drive roller 113, thereby correcting the skew-feed of the sheet and aligning the leading end of the sheet.

Then, the paired regist rollers 117, 118 and the drive roller 113 are driven simultaneously in registration with an image so that the sheet is fed with keeping the loop in the sheet, thereby maintaining the speed of the paired resist rollers 117, 118 stably. At a downstream side of the paired regist rollers 117, 118, there are arranged a laser optical system 120, an electrophotographic cartridge 121, a transfer charger 122 to which a bias is applied, a convey guide 123, a thermal and pressure fixing roller portion 124, a pair of discharge rollers 125, and a discharge tray 126. These elements 120 to 124 act as an image forming means, and all of these elements constitute an image forming apparatus.

Also in this embodiment, as in the aforementioned embodiment, a sheet supplying amount C of the sheet supply roller 103 is selected by setting the gear train and semi-circular portion of the sheet supply roller so that the relation between the amount C and a sheet path length A between the leading end of the sheet in the sheet supply cassette 101 and a nip of the paired retard rollers 111, 112 and a sheet path length C between the nip of the paired retard rollers and a nip of the drive roller 113 becomes $A<C<B$.

Figure 11:
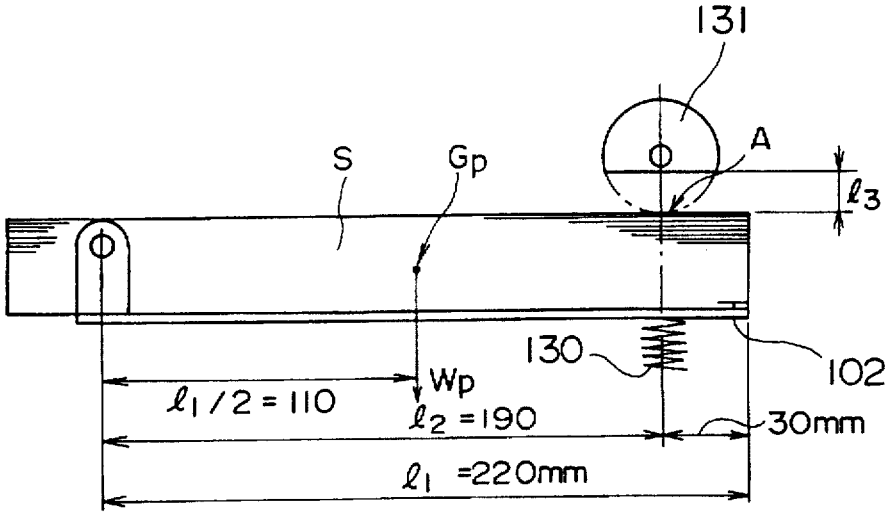
FIG. 11 is an explanatory view showing various dimension of a cassette according to a third embodiment of the present invention.
Figure 12:
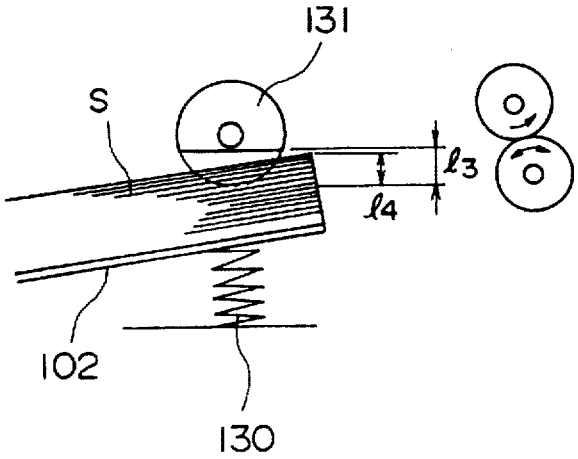
FIG. 12 is an explanatory view showing a condition that the cassette of FIG. 11 is being used.

FIGS. 11 and 12 show a third embodiment of the present invention, wherein a spring constant of a spring 130 for providing the sheet supplying pressure disposed below the sheet stacking plate 102 is selected to maintain the sheet supplying pressure between the sheet stack and a sheet supply roller 131 always constant even when an amount of the sheets stacked on the sheet stacking plate. For example, when a distance $l_1$ between the pivot center of the sheet stacking plate 102 and a free end of the sheet stacking plate is 220 mm and a sheet width of the sheet having A4 longitudinal size is 210 mm, regarding a sheet having 80 g/m$^2$, an area of the sheet is 220×210 mm$^2$, a weight of one sheet is 3.7 grams and a thickness of the sheet is about 0.1 mm. Thus, the weight Wp of ten sheets (thickness of which is 1 mm) becomes 37 grams.

Now, when the spring 130 is disposed immediately below the sheet supply roller 131 in order to make the pressure of the sheet supply roller 131 constant regardless of the amount of the stacked sheets, the spring constant of the spring becomes $$(37\times110)\div190=21.4 \text{ g/mm}.$$

Normally, since the pressure between the sheet supply roller 131 and the sheet stack requires about 200 grams, a pushing amount $l_4$ of the spring at a piont A (FIG. 11) becomes 200/21.4=9.3 mm. Thus, by setting a distance $l_3$ between the sheet supply roller 131 and the sheet stack (when they are spaced apart from each other) greater than the distance $l_4$, it is possible to carry out the present invention without any upper regulating means.

Incidentally, in the first embodiment, while the members similar to the separating claws conventionally used for regulating the top surface of the sheet stack were utilized as the auxiliary separating claws, since the paired retard rollers acting as the main separation means are arranged at the downstream side of the auxiliary separating claws, fundamentally, the sheet supply portion only may regulate the top surface (height) of the sheet stack, and, thus, the configuration of the sheet supply portion and the contact position between the sheet supply roller and the sheet stack are not limited to the first embodiment. That is, when the semi-circular sheet supply roller is in the stopped condition, a distance between the sheet stack and the sheet supply roller may be established and the sheet stack may be held at a certain height.

As mentioned above, by providing a sheet supplying apparatus comprising a sheet supply means including the semi-circular sheet supply roller, a separation means including the pair of retard rollers disposed at the downstream side of the sheet supply roller, and a feed means including the pair of feed rollers disposed at the downstream side of the retard rollers, and wherein the normal rotation drive roller of the paired retard rollers is synchronized with one revolution of the sheet supply roller and the above-mentioned relation $A<C<B$ is satisfied, it is possible to greatly simplify the construction in comparison with the conventional sheet supplying apparatus of retard roller type. That is to say, the number of parts can be reduced, the reliability of the apparatus can be improved, and the cost and space can be saved.

By applying the present invention, it is possible to provide a sheet supplying apparatus having the more excellent sheet supply and sheet separation ability in a compact copying machine, a compact printer and the like. Particularly, in an image forming apparatus wherein a sheet supply cassette is mounted and dismounted in a direction perpendicular to a sheet feeding direction, it is possible to make the apparatus small-sized effectively.

Next, a fourth embodiment of the present invention will be explained with reference to FIGS. 13 to 17.

Figure 13:
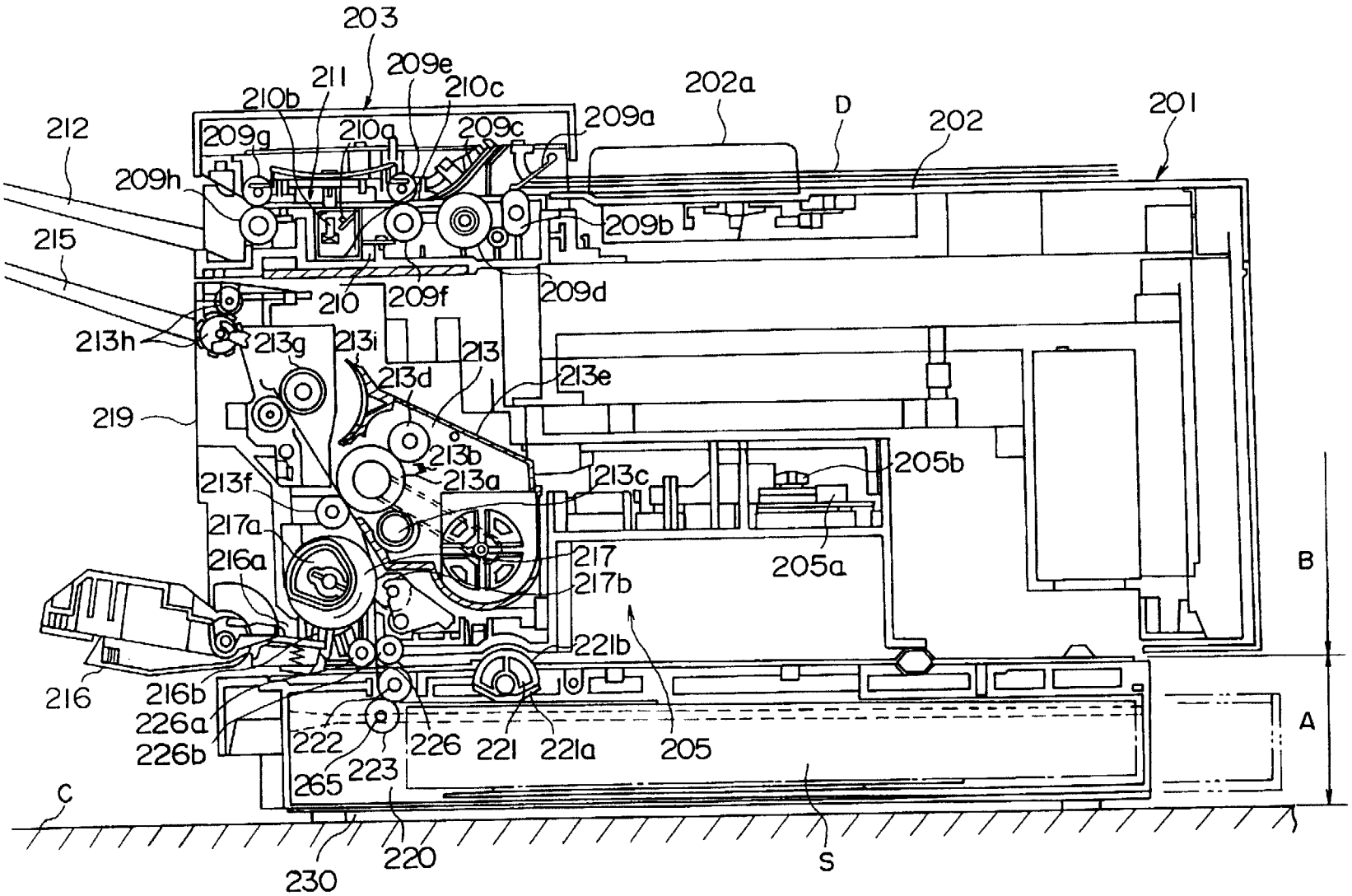
FIG. 13 is an elevational sectional view of a facsimile system to which a fourth embodiment of the present invention is applied.
Figure 14:
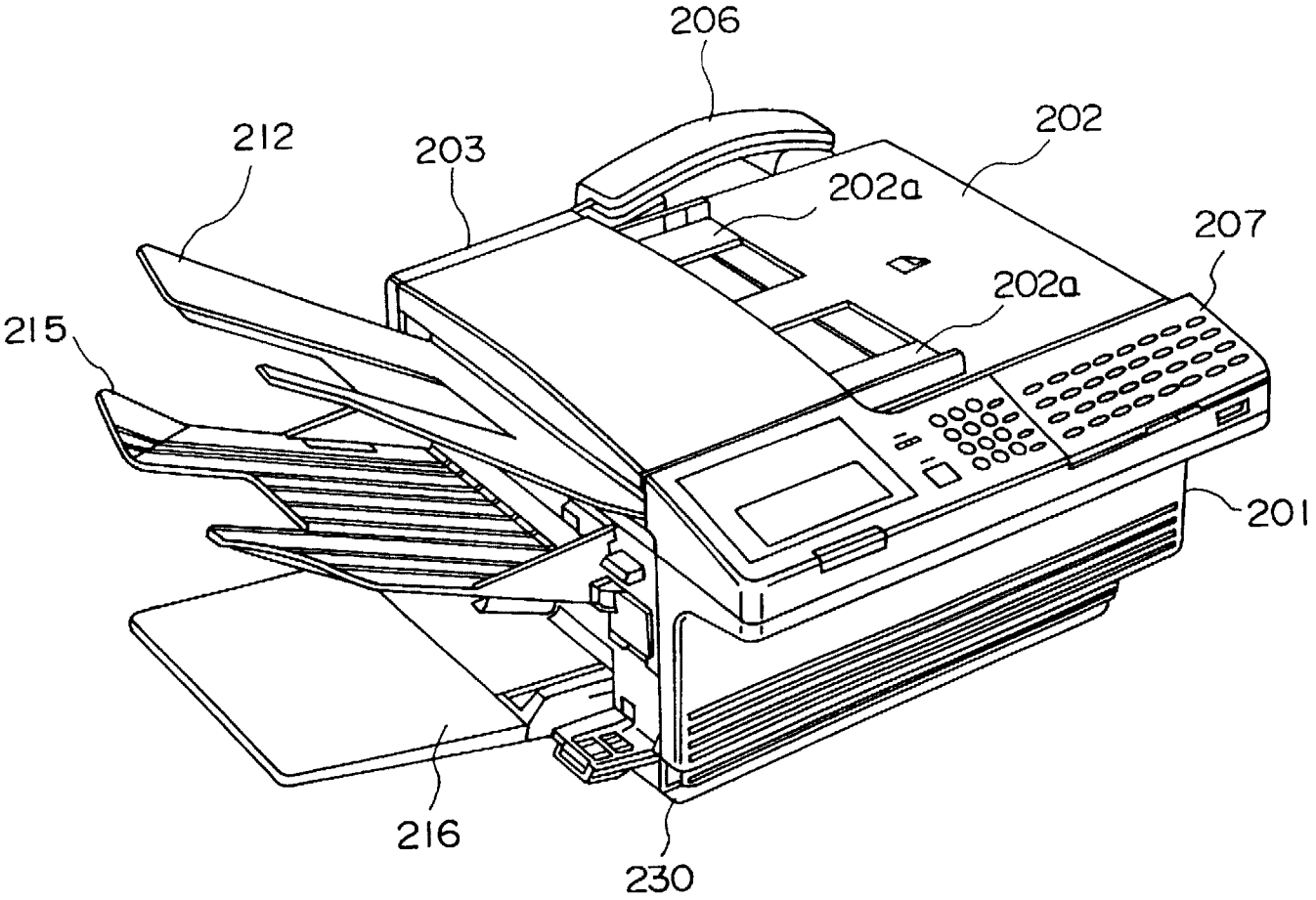
FIG. 14 is a perspective view of the facsimile system of FIG. 13.

First of all, explaining the whole construction of a facsimile system having a sheet supplying apparatus A according to the fourth embodiment with reference to FIGS. 13 and 14, the facsimile system is constituted by the sheet supplying apparatus A rested on a horizontal installation floor C and providing a sheet supplying portion, and a facsimile B rested on the sheet supplying apparatus A and adapted to receive the sheet from the sheet supplying apparatus A.

The facsimile B has an original stacking support 202 which is formed on an upper cover of a frame 201 and on which a plurality of originals D can be rested, an optical reading sytem 203 disposed at an upper portion of the frame 201 at one side (left side in FIG. 13) thereof and adapted to read image information on the original D sent from the original stacking support 202, and a recording system 205 comprising a laser beam printer disposed below the optical reading system 203. Further, a telephone 206 (FIG. 14) and an operation panel 207 are arranged on the top surface of the frame 201.

The optical reading system 203 is designed so that the originals D stacked on the original stacking support 202 are separated one by one by a pre-feed pushing member 209*a* and a pre-feed roller 209*b* abutted against the pushing member, and a separation pushing member 209*c* and a separation roller 209*d* abutted against the separation pushing member, and the separated original is sent to a contact sensor (sensor of contact type) 210 by an original supply roller 209*e* and a main feed roller 209*f* abutted against the supply roller, and the image-information on the original D is read while closely contacting the original D with the contact sensor 210 by an urging means 211, and then the original D is discharged onto an original discharge tray 212 by a discharge roller 209*g* and a discharge roller 209*h* abutted against the discharge roller 209*g*. The contact sensor 210 is designed so that light from an LED 210*a* as a light source is illuminated onto the image information surface of the original D, and the light reflected from the image information surface is focused on a photoelectric converter element 210*c* through a short-focus focusing lens 210*b*, thereby reading the image information. The read information is sent to a recording portion of another machine in a facsimile mode or is sent to the recording system 205 in a copy mode.

Incidentally, left and right sliders 202*a* slidable in directions (widthwise direction of the original) perpendicular to an original feeding direction are arranged on the original stacking support 202, so that the originals D are positioned in the left-and-right direction by slightly abutting the sliders against the left and right edges of the original stack D on the original stacking support 202.

Further, the recording system 205 is designed so that a modulated signal is emitted from a laser beam generator 205*a* on the basis of an image signal from the contact sensor 210, and the modulated beam is illuminated onto a photosensitive drum 213*a* in an image forming station 213 as scanning light by a polygon mirror 205*b* thereby to form the image information on a surface of the photosensitive drum 213*a*, and the image information on the drum is transferred onto the sheet S supplied from the sheet supplying apparatus A and the image information is fixed to the sheet, and then the sheet S is discharged.

The photosensitive drum 213*a* is integrally incorporated into a recording cartridge (process cartridge) 213*e* together with a primary charger 213*b*, a developing roller 213*c* and a cleaning roller 213*d*, and the recording cartridge 213*e* is removably mounted to the frame 201 of the facsimile system. The surface of the photosensitive drum 213*a* is uniformly charged by the primary charger 213*b*. When the scanning light from the polygon mirror 205*b* is illuminated on the surface of the photosensitive drum, a latent image is formed on the drum, which latent image is in turn visualized with toner from the developing roller 213*c*.

A transfer charger 213*f* is disposed around the photosensitive drum 213*a* in the image forming station 213, and fixing rollers 213*g* and discharge rollers 213*h* are disposed in a sheet feeding path arranged at a downstream side of the photosensitive drum 213*a*, so that, after the toner image formed on the photosensitive drum 213*a* is transferred to the sheet S (supplied from the sheet supplying apparatus A) by the transfer charger 213*f*, the toner image is fixed to the sheet by the fixing rollers 213*b*, and then the sheet is discharged onto a sheet discharge tray 215 removably mounted on one side (left side in FIGS. 13 and 14) of the frame 201 by the discharge rollers 213*h*.

Further, a stacking tray 216 for stacking manual insertion sheets S is openably mounted on one side of the frame 201 below the sheet discharge tray 215. By opening the stacking tray 216 in a horizontal condition, a manual sheet insertion opening 216*a* is opened. When the sheets S on the stacking tray 216 are inserted into the manual sheet insertion opening 216*a*, the sheets are urged against a larger feed roller 217*a* of a pair of feed rollers 217 (comprising the larger feed roller 217*a* and a smaller feed roller 217*b*) by an urging member 216*b*, thereby separating the sheets one by one by the feed roller 217*a*. Then, the separated sheet is sent between the transfer charger 213*f* and the photosensitive drum 213*a* by the paired feed rollers 217*a*, 217*b*.

Incidentally, the stacking tray 216 is openably (cockably) attached to an opening/closing lid 219 openably mounted on one side of the frame 201, and the sheet discharge tray 215 is also removably attached to the opening/closing lid 219. By opening the opening/closing lid 219, the recording cartridge 213*e* can be exchanged. Further, the opening/closing lid 219 is moved in synchronous with a drum shutter 213*i* provided on the recording cartridge 213*e* so that when the lid 219 is opened the drum shutter 213*i* is closed and when the lid 219 is closed the drum shutter 213*i* is opened.

Further, although not shown, an operation button for a release lever for releasing the lock of the opening/closing lid 219 is arranged in a recess formed in a front surface of the lid 219. The recess is normally closed by a protection cover integrally formed with the sheet discharge tray 215 so that the lock of the opening/closing lid 219 cannot be released by the operation button so long as the sheet discharge tray 215 is attached to the lid 219. Thus, the exchange of the recording cartridge in a half-opened condition of the opening/closing lid 219 (in this condition, the lid cannot be completely opened with the interference with the sheet discharge tray 215) can be prevented, thereby preventing the recording cartridge 123*e* from damaging. Further, since the half-opened condition of the lid 219 can be prevented, it is possible to prevent the half-opened condition of the drum shutter 213*i*, thereby preventing the deterioration of the image quality due to the exposure of the photosensitive drum 213*a*.

The sheet supplying apparatus A has a sheet supply cassette 220 for stacking and containing sheets S, and a sheet feeding portion (referred to as "feeder" hereinafter) 230 for supplying the sheet S from the sheet supply cassette 220 to the facsimile B. The sheet supplying apparatus A is designed so that the sheets S fed out from the sheet supply cassette 220 (which can be dismounted from the frame 201 in the left direction in FIG. 13) by a sheet supply roller 221 are separated one by one by a normal rotation drive roller 222 and a retard roller 223, and the separated sheet S is sent between the transfer charger 213*f* and the photosensitive drum 213*a* by a pair of regist rollers 226*a*, 226*b* disposed at a sheet inlet opening 226 formed in a bottom of the frame 201 via a pair of feed rollers 217 at a sheet supply timing that a tip end of the image formed on the photosensitive drum 213*a* is aligned with a leading end of the sheet S.

Although the number of sheets stacked in the sheet supply cassette 220 is normally 250 (sheets) in a copying machine, regarding the facsimile apparatus, since the system is always powered ON and an operator not always monitors the facsimile system or the communication from abroad must be permitted even in the midnight or the communication must be permitted during the long vacation, the number of the sheets S stacked in the cassette requires about 500 (sheets). Further, as mentioned above, unlike to the copying machine, since the operator does not monitor the facsimile apparatus normally and the jam treatment cannot be effected quickly, the sheet supplying ability required for the sheet supplying apparatus A for the facsimile system must be excellent more than that of the sheet supplying apparatus for the copying machine.

Figure 15:
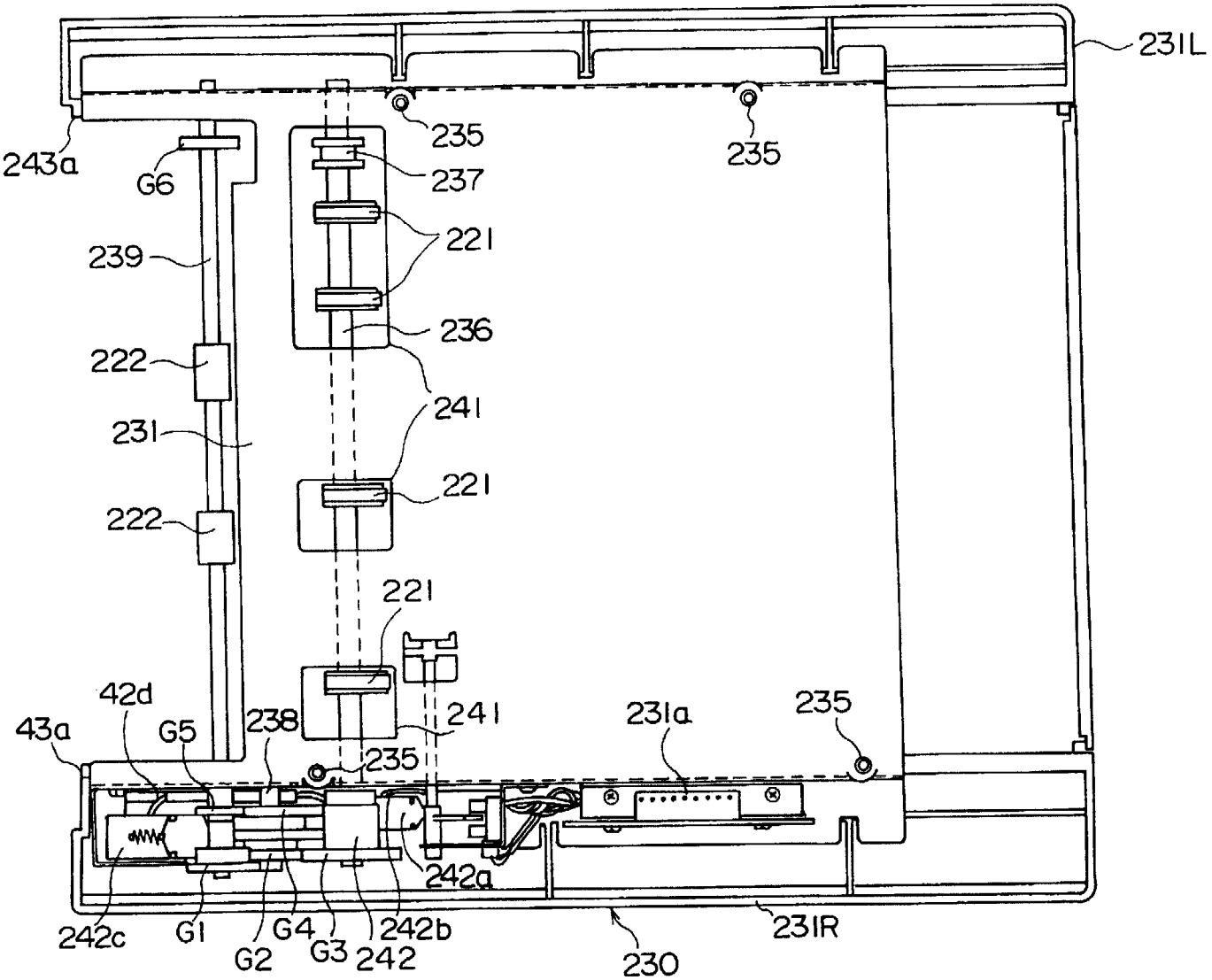
FIG. 15 is a plan view of a sheet supplying apparatus of FIG. 13.
Figure 16:
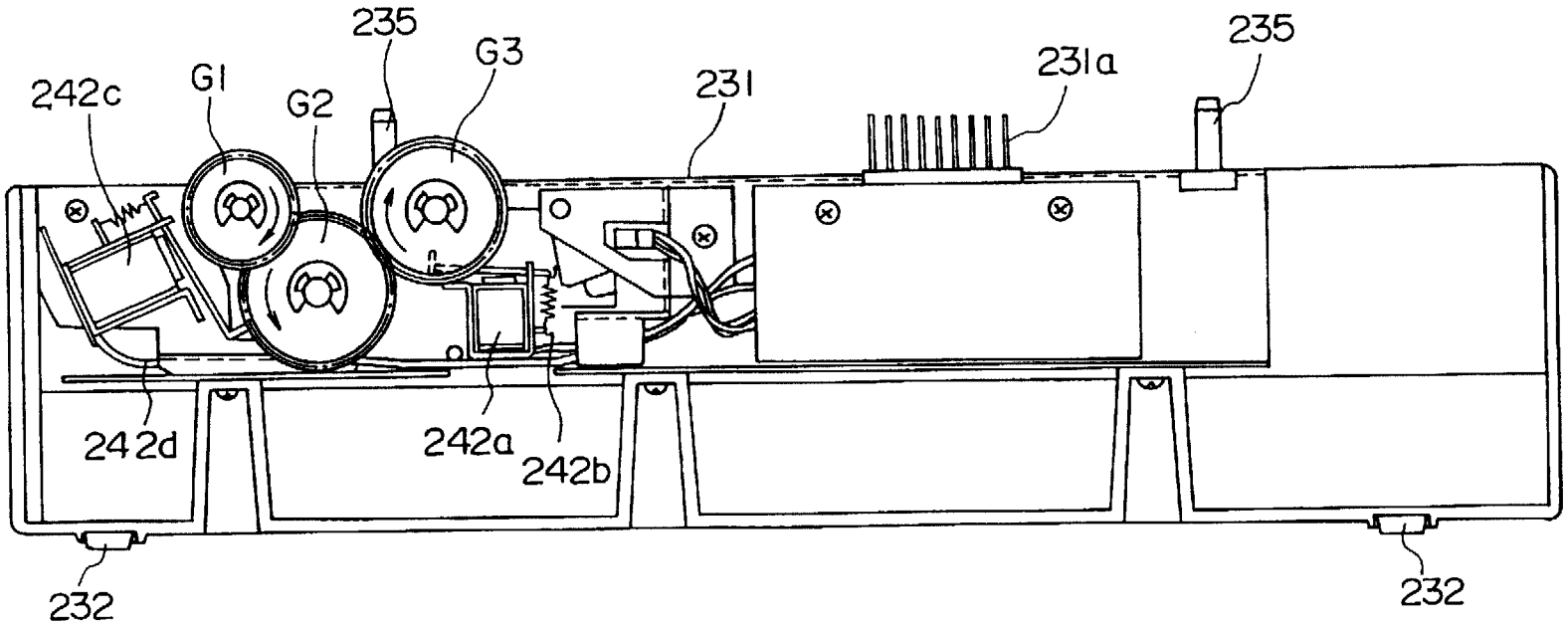
FIG. 16 is an elevational sectional view of the sheet supplying apparatus of FIG. 13.
Figure 17:
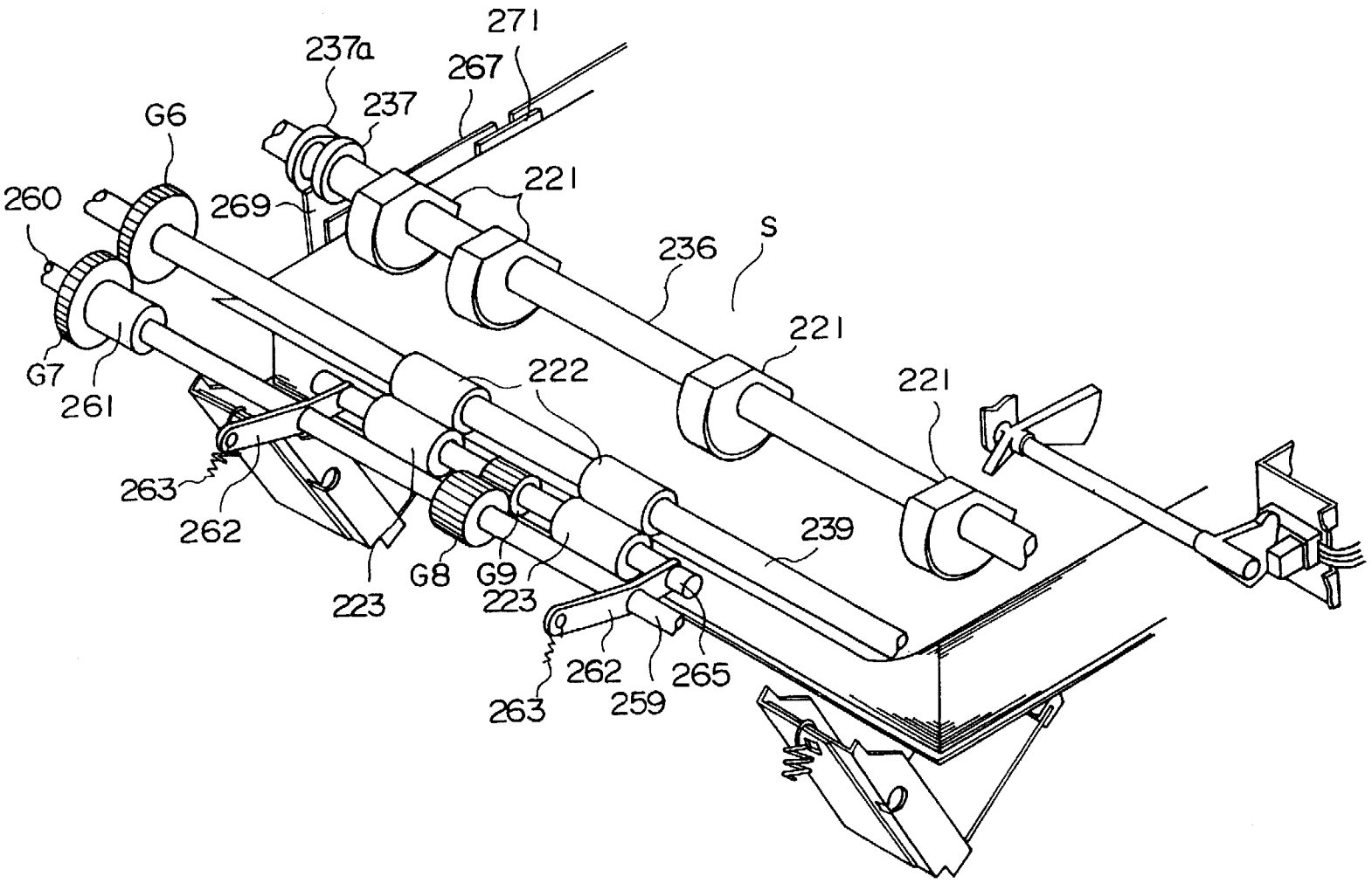
FIG. 17 is a perspective view of the sheet supplying apparatus of FIG. 13.
Figure 18:
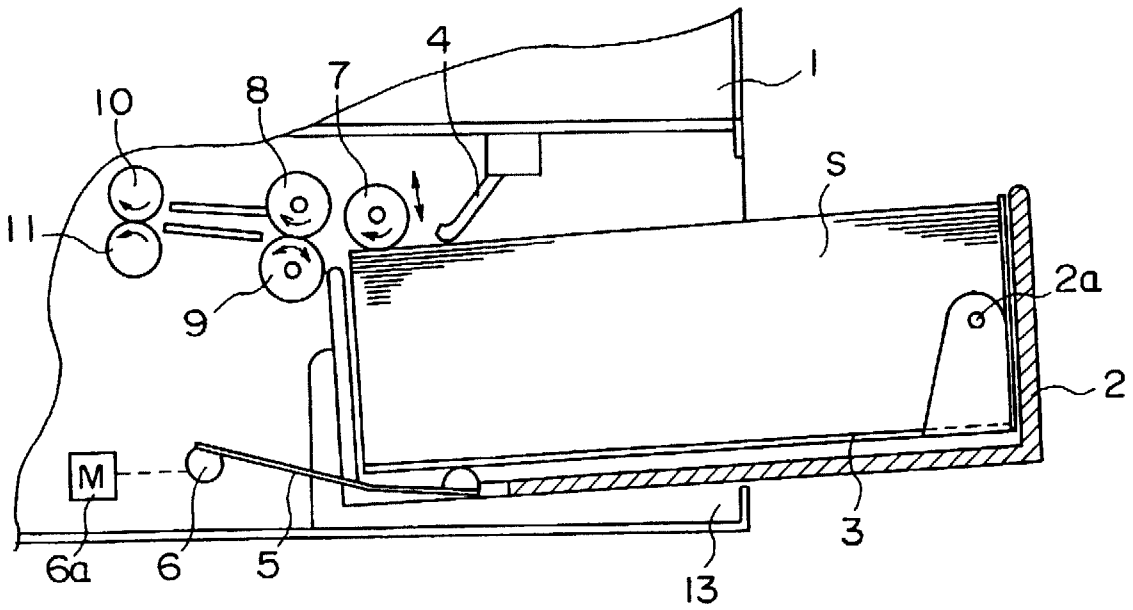
FIG. 18 PRIOR ART
FIG. 18 is an elevational sectional view of a conventional sheet supplying apparatus.

FIG. 15 is a plan view of the feeder 230, and FIG. 16 is an elevational sectional view of a feeder driving portion.

A feeder upper plate 231 (FIG. 15) is arranged at an upper portion of the feeder 230, and left and right hollow supports 231L, 231R extending in a front-and-rear direction in parallel with each other are attached to left and right edge portions of the feeder upper plate 231. Further, rubber foots 232 (FIG. 16) are secured to lower surfaces of the hollow supports 231L, 231R. When the feeder 230 is rested on the installation floor C, a cassette accommodating space (referred to as "cassette space" hereinafter) is defined by a lower surface of the feeder upper plate 231, an upper surface of the installation floor C and inner surfaces of the left and right hollow supports 231L, 231R. Four positioning bosses 235 (two at left, two at right) are uprightly formed on the feeder upper plate 231 (FIG. 15). By fitting these positioning bosses 235 into corresponding holes formed in the lower surface of the facsimile B to position the facsimile B on the feeder 230, the sheet supplying apparatus A is combined with the facsimile B. In this case, the sheet supplying apparatus A is electrically connected to the facsimile B by a connector member 231*a* secured to one end of the feeder upper plate 231.

Between the left and right hollow supports 231L, 231R, a sheet supply roller shaft 236 is rotatably supported, and a sheet supply roller (sheet supply means) comprising four sheet supply roller portions 221 spaced apart from each other with predetermined intervals is secured to the sheet supply roller shaft 236. A pressure plate regulating roller 237 serves to regulate a position of a pressure plate 269 integrally formed with a sheet side regulating plate 267, which regulating roller is provided with a continuous peripheral groove 237*a*. In the illustrated embodiment, each sheet supply roller portion 221 has a semi-circular cross-section (D-cut roller). Normally, the sheet supply roller portions 221 are stopped with D-cut portions 221*a* thereof faced downwardly. A normal rotation drive roller shaft 239 (FIG. 15) is rotatably supported between the left and right hollow supports 231L, 231R, and a normal rotation drive roller 222 is secured to the roller shaft 239.

The sheet supply roller shaft 236 is disposed in parallel with the normal rotation drive roller shaft 239, and the shaft 239 is arranged near a free end of the feeder upper plate 231 and the sheet supply roller shaft 236 is arranged at an upstream side of the normal rotation drive roller shaft 239 in the sheet feeding direction. Further, a cylindrical portion 221*b* opposed to the D-cut portion 221*a* of each sheet supply roller portion 221 is partially protruded upwardly from the feeder upper plate 231 through a through opening 241 formed in the feeder upper plate 231.

A gear train G1 to G5 shown in FIGS. 15 and 16 includes an input gear G1 idly mounted on a right end of the normal rotation drive roller shaft 239 for transmitting the driving force from the facsimile B, a first idler gear G2 mounted on a shaft 238, a sheet supply roller shaft gear G3 idly mounted on a right end of the sheet supply roller shaft 236 and connected or disconnected with respect to this shaft by a one revolution clutch 242, a second idler gear G4 mounted on the same shaft 238 as the first idler gear G2 and connected or disconnected with respect to the first idler gear G2 by a spring clutch idly mounted on the shaft 238, and a normal rotation drive roller shaft gear G5 arranged at the left of the input gear G1 and secured to the normal rotation drive roller shaft 239. Incidentally, a cassette drive gear G6 is secured to a left end of the normal rotation drive roller shaft 239.

When the feeder 230 of the facsimile B is turned ON, the input gear G1 is rotated in a clockwise direction, thereby rotating the gears G2, G3 (FIGS. 15 and 16). The first and second idler gears G2, G4 are rotated in anti-clockwise directions, and the sheet supply roller shaft gear G3 and the normal rotation drive roller shaft gear G5 are rotated in clockwise directions. The sheet supply roller shaft gear G3 is disconnected from the sheet supply roller shaft 236 to rotate idly on the shaft 236 when an electromagnetic solenoid plunger 242*a* of the spring clutch 242 is turned OFF (clutch-off). Accordingly, in this condition, the rotational force is not transmitted to the sheet supply roller shaft 236, thereby maintaining the sheet supply roller shaft 236 in a stopped condition. When the electromagnetic solenoid plunger 242*a* is temporarily turned ON, the spring clutch 242 becomes a clutch-on condition, thereby connecting the sheet supply roller shaft gear G3 to the sheet supply roller shaft 236 to rotate the latter in the clockwise direction, and, accordingly to rotate the sheet supply roller portions 221 in clockwise directions in FIG. 13. As the sheet supply roller shaft 236 and accordingly the sheet supply roller portions 221 are rotated by one revolution, the clutch-off condition is restored, thereby stopping the sheet supply roller shaft 236 and the sheet supply roller portions 221.

The second idler gear G4 is disconnected from the first idler gear G2 when an electromagnetic solenoid plunger 242*c* of the spring clutch is turned OFF (clutch-off), so that the gear G4 is in a stopped condition. In this condition, the rotational force is not transmitted to the normal rotation drive roller shaft 239, thereby maintaining the normal rotation drive roller 222 in a stopped condition. When the electromagnetic solenoid plunger 242*c* is turned ON, the spring clutch becomes the clutch-on condition, thereby connecting the second idler gear G4 to the first idler gear G2 to rotate the normal rotation drive roller shaft gear G5 in the clockwise direction. Accordingly, the normal rotation drive roller 222 is rotated in the clockwise direction.

Lead wires 242*b*, 242*d* for the electromagnetic solenoid plungers 242*a*, 242*c* are connected to a control circuit (not shown) of the facsimile B via an electric coupling member comprising the connector member 231*a* of the sheet supplying apparatus A and a member (not shown) of the facsimile B when the facsimile B is properly rested on the sheet supplying apparatus A. Alternatively, after the facsimile B is properly rested on the sheet supplying apparatus A, plugs (not shown) connected to one ends of the lead wires 242*b*, 242*d* may be inserted into sockets (not shown) of the facsimile B to connect the electromagnetic solenoid plungers 242*a*, 242*c* to the control circuit of the facsimile B.

The reference numeral 259 (FIG. 17) denotes a relay shaft rotatably supported by the sheet supply cassette 220; and 260 denotes a cassette input shaft rotatably supported by the sheet supply cassette 220. These shafts 259, 260 are coaxially positioned. A torque limiter 261 serves to connect the relay shaft 259 to the input shaft 260, and levers 262 are pivotally mounted on the relay shaft 259. A retard roller shaft 265 is rotatably supported by one ends of the levers 262. Retard roller biasing springs 263 each has one end connected to the sheet supply cassette 220 and the other end connected to the corresponding lever 262, and these springs serve to bias the levers 262 in clockwise directions. A cassette input gear G7 is secured to the cassette input shaft 260 and adapted to transmit the driving force from the feeder 230 to the sheet supply cassette 220, a third idler gear G8 is secured to the relay shaft 259, and a retard roller shaft gear G9 is secured to the retard roller shaft 265. A retard roller 223 is secured to the retard roller shaft 265 and is urged against the normal rotation drive roller 222 of the feeder 230 and is in parallel with the normal rotation drive roller shaft 239 when the cassette is mounted to the feeder 230.

When the sheet supply cassette 220 is mounted to the feeder 230, the driving force from the facsimile system is transmitted to the sheet supply cassette 220 through the feeder 230. In a condition that the sheet supply cassette 220 is mounted to the feeder 230, when the sheet supply command is emitted from the facsimile system, the cassette input gear G7 is rotated in an anti-clockwise direction in response to the clockwise rotation of the cassette drive gear G6. That is, the cassette input shaft 260 is rotated in an anti-clockwise direction. When the torque acting on the torque limiter 261 rotating in the clockwise direction exceeds a predetermined value, the cassette input shaft 260 is disconnected from the relay shaft 259, thereby not transmitting the driving force of the cassette input shaft 260 to the relay shaft 259. Further, when the clockwise torque acting on the torque limiter is below the predetermined value, the cassette input shaft 260 is connected to the relay shaft 259, thereby rotating the third idler gear G8 in an anti-clockwise direction and the retard roller shaft gear G9 and accordingly the retard roller shaft 265 in a clockwise direction.

As mentioned above, in the illustrated embodiment, since the retard roller 223 is provided on the sheet supply cassette 220, the facsimile system can be made small-sized. Further, although the retard roller is easily worn, since it is provided on the sheet supply cassette 220, the retard roller can easily be exchanged.

What is claimed is:

1. An image forming apparatus, comprising:

a sheet cassette drawably mounted onto a main body of said apparatus and for containing sheets therein;

a sheet supply roller provided in the main body for feeding out a sheet, said sheet supply roller having a peripheral portion that is partially cut;

sheet support means provided in said sheet cassette for supporting the sheets and urging the sheets towards said sheet supply roller;

separating means for separating the sheets fed out from said sheet support means by said sheet supply roller, said separating means having a normal rotation roller provided in the main body and rotating in a sheet feeding direction and a retard roller provided in said sheet cassette and rotating in a direction opposite to the sheet feeding direction;

retard roller supporting means provided in said sheet cassette for rockably supporting said retard roller, and urging means for urging the retard roller toward the normal rotation roller when said sheet cassette is mounted on said main body;

a drive output member provided in the main body of the apparatus and connected to a drive source provided in the main body of the apparatus; and a drive input member connected to the retard roller to be engaged with the drive output member when said sheet cassette is mounted onto the main body to transmit the drive force to the retard roller.

2. An image forming apparatus according to claim 1, wherein a draw-out direction of the sheet cassette from the main body and the sheet feed-out direction from said sheet support means by said sheet supply roller are the same, and the retard roller is disposed forwardly in the draw-out direction of the sheet cassette.

3. An image forming apparatus according to claim 1, wherein the retard roller supporting means is a lever rockably attached to the sheet cassette, and said urging means is a coil spring.

4. An image forming apparatus according to claim 1, wherein the drive output member is an output gear receiving drive force from the drive source, and said drive input member is an input gear transmitting the drive force to the retard roller, so that when the sheet cassette is mounted on to the main body the input gear meshes with the output gear to thereby transmit the drive force of said drive source is transmitted to the retard roller.

5. An image forming apparatus according to claim 4, wherein the drive output gear receives the drive force from a drive shaft of the normal rotation roller.

6. An image forming apparatus according to claim 1, wherein in a course of drive transmitting means for transmitting the drive force from the drive input member to the retard roller, a torque limiter for transmitting only the drive force smaller than a predetermined value to the retard roller is provided.

7. An image forming apparatus according to claim 1, further comprising control means for controlling rotation of said sheet supply roller so that, upon non-supplying of the sheet, said sheet supply roller stops at a position where the cut portion thereof faces to the sheets supported by said sheet support means.

8. An image forming apparatus according to claim 1, further comprising convey means for conveying upwardly to the main body a sheet separated by said separating means.

9. An image forming apparatus according to claim 1, wherein said sheet support means is rockably supported and includes an urging member biasing upward the sheet support means to urge the supported sheets against said sheet supply roller.

10. An image forming apparatus according to claim 9, further comprising regulation means for regulating an upper surface of the sheets urged by said sheet support member toward said sheet supply roller to maintain in a predetermined position where said sheet supply roller contacts with the upper surface of the sheets to feed out the sheet.

11. An image forming apparatus according to claim 10, wherein said regulating means is a separating pawl separating the sheets fed out by said sheet supply roller.

12. An image forming apparatus, comprising:

a sheet cassette drawably mounted onto a main body of said apparatus and for containing sheets therein;

a sheet supply roller provided in the main body for feeding out a sheet, said sheet supply roller having a peripheral portion that is partially cut;

sheet support means provided in said sheet cassette for supporting the sheets and urging the sheets toward said sheet supply roller;

separating means for separating the sheets fed out from said sheet support means by said sheet supply roller, said separating means having a normal rotation roller provided in the main body and rotating in a sheet feeding direction, and a retard roller provided in said sheet cassette and rotating in a direction opposite to the sheet feeding direction;

a drive output member provided in the main body of the apparatus and connected to a drive source provided in the main body of the apparatus;

a drive input member connected to the retard roller to be engaged with the drive output member when said sheet cassette is mounted onto the main body to transmit the drive force to the retard roller; and drive transmitting means provided in the sheet cassette for transmitting a drive force from the drive input member to the retard roller, wherein said drive transmitting means has a torque limiter for transmitting only a drive force smaller than a predetermined value to the retard roller.

13. An image forming apparatus according to claim 12, wherein a draw-out direction of the sheet cassette from the main body and the sheet feed-out direction from said sheet support means by said sheet-supply roller are the same, and the retard roller is disposed forwardly in the draw-out direction of the sheet cassette.

14. An image forming apparatus according to claim 12, wherein said sheet support means is rockably supported and includes an urging member biasing upward the sheet support means to urge the supported sheets against said sheet supply roller.

15. An image forming apparatus according to claim 14, further comprising regulation means for regulating an upper surface of the sheets urged by said urging member toward said sheet supply roller to maintain in a predetermined position where said sheet supply roller contacts with the upper surface of the sheets to feed out the sheet.

16. An image forming apparatus according to claim 15, wherein said regulating means is a separating pawl to separate the sheets fed out by said sheet supply roller.

* * * * *

UNITED STATES PATENT AND TRADEMARK OFFICE

CERTIFICATE OF CORRECTION

PATENT NO. : 5,722,654
DATED : March 3, 1998
INVENTOR(S) : Tadashi YAGI, et al.

It is certified that error appears in the above-identified patent and that said Letters Patent is hereby corrected as shown below:

Column 1, line 30, delete "a" and insert therefor --the--;
Line 61, delete "indirection" and insert therefor --direction--.

Column 3, line 45, delete "has" and insert therefor --have--.

Column 5, line 38, delete "the", second occurrence.

Column 7, line 28, delete "resist" and insert therefor --regist--.

Column 8, line 1, delete "piont" and insert therefor --point--.

Column 10, line 29, delete "damaging" and insert therefor --be damaged--;
Line 54, after "operator", insert --does--.

Column 11, line 5, delete "foots" and insert therefor --feet--.

Column 12, line 53, delete "has" and insert therefor --have--.

Signed and Sealed this

Fifteenth Day of September, 1998

*Attest:*

*Attesting Officer*

BRUCE LEHMAN

*Commissioner of Patents and Trademarks*